US007591645B2

(12) United States Patent
Sewalt

(10) Patent No.: US 7,591,645 B2
(45) Date of Patent: Sep. 22, 2009

(54) CHILD RESISTANT ROLL-AND-PRESS LIGHTER

(75) Inventor: Carel Sewalt, Onstwedde (NL)

(73) Assignee: Swedish Match Lighters B.V., AM Assen (NL)

( * ) Notice: Subject to any disclaimer, the term of this patent is extended or adjusted under 35 U.S.C. 154(b) by 4 days.

(21) Appl. No.: 11/915,980

(22) PCT Filed: Aug. 24, 2006

(86) PCT No.: PCT/IB2006/002310

§ 371 (c)(1),
(2), (4) Date: Nov. 29, 2007

(87) PCT Pub. No.: WO2007/023373

PCT Pub. Date: Mar. 1, 2007

(65) Prior Publication Data

US 2008/0206694 A1 Aug. 28, 2008

(30) Foreign Application Priority Data

Aug. 25, 2005 (GB) ..... 0517363.8

(51) Int. Cl.
*F23D 11/36* (2006.01)
*F23Q 1/02* (2006.01)

(52) U.S. Cl. ..... 431/153; 431/276; 431/277

(58) Field of Classification Search ..... 431/153
See application file for complete search history.

(56) References Cited

U.S. PATENT DOCUMENTS 5,165,885 A 11/1992 Iwahori
5,271,731 A 12/1993 Hsin-Chung (Continued)

FOREIGN PATENT DOCUMENTS

EP 0 611 096 A2 8/1994

(Continued)

OTHER PUBLICATIONS

Swedish Match Lighters B.V., Written Opinion of the International Searching Authority, PCT/IB2006/002310, Aug. 24, 2006.

(Continued)

*Primary Examiner*—Kenneth B Rinehart
*Assistant Examiner*—Daniel A Bernstein
(74) *Attorney, Agent, or Firm*—Fay Sharpe LLP

(57) ABSTRACT

A child resistant roll-and-press lighter includes at least one abutment surface (32; 41; 45) which engages a corresponding counterabutment surface (33; 42; 44) on the lever (20; 50, 51). The surfaces disengage to release the lever for pivotal movement, when and only when at least a predetermined minimum force is applied to the lever pad (23) by the user. The abutment or counterabutment surface may be arranged on a transversely deformable, resilient engaging element (30; 43; 46) which engages the corresponding surface in tension. Alternatively the lever may be mounted in elongate slots so as to translate and so disengage the cooperating surfaces when the minimum force is applied by the user. Alternatively the counterabutment surface may be arranged on a sliding catch (51) housed beneath the lever pad. The minimum force is easily applied by the adult user by rotating the wheel assembly (10) at normal speed.

13 Claims, 4 Drawing Sheets

U.S. PATENT DOCUMENTS

| | | | | |
|---|---|---|---|---|
| 5,324,193 | A * | 6/1994 | Pan | 431/153 |
| 5,645,414 | A * | 7/1997 | Wang | 431/153 |
| 5,704,776 | A | 1/1998 | Sher | |
| 5,947,715 | A | 9/1999 | Sheng et al. | |
| 5,971,748 | A | 10/1999 | Rogelet | |
| 6,095,795 | A | 8/2000 | Potskhishvili et al. | |
| 6,099,297 | A * | 8/2000 | Chan | 431/153 |
| 6,102,689 | A | 8/2000 | Man | |
| 6,612,831 | B1 * | 9/2003 | Ansquer et al. | 431/153 |
| 2003/0031968 | A1 | 2/2003 | Sewalt | |

FOREIGN PATENT DOCUMENTS

| | | |
|---|---|---|
| GB | 2 409 018 A | 6/2005 |
| WO | WO 91/10098 | 7/1991 |
| WO | WO 94/10503 | 5/1994 |
| WO | WO 01/38795 A1 | 5/2001 |

OTHER PUBLICATIONS

Swedish Match Lighters B.V., International Search Report, PCT/IB2006/002310, Aug. 24, 2006.
GB Search Report, GB0517363.8, Jan. 17, 2006.

* cited by examiner

CHILD RESISTANT ROLL-AND-PRESS LIGHTER

CROSS-REFERENCE TO RELATED APPLICATIONS

This application is a national stage entry of international application number PCT/IB2006/002310, having international filiong date Aug. 24, 2006, which was published in English, and which claims priority to Great Britain patent application No. GB 0517363.8, filed Aug. 25, 2005.

This invention relates to child resistant mechanisms in roll-and-press lighters.

BACKGROUND OF THE INVENTION

A roll-and-press lighter typically comprises a lighter body containing a reservoir of pressurized fuel, a valve for releasing fuel from the reservoir to a burner nozzle, a lever for operating the valve, and a rotatable wheel assembly comprising a sparkwheel and a pair of thumbwheels. A flint is mounted on the lighter body so that it presses against the sparkwheel, and a metal windshield is usually arranged around the burner.

Such lighters are commonly used as cigarette lighters, and derive their name from their operating procedure. In order to operate the lighter the typical user first rolls the wheel assembly by drawing his thumb rapidly across the thumbwheels. The end of the lever opposite the valve is provided with a pad which is positioned to receive the user's thumb as it falls off the wheel assembly at the end of its stroke. By pressing down on this pad the user opens the valve to release fuel to the burner, where it is ignited by sparks produced by friction between the flint and the rotating sparkwheel.

In order to reduce accidents and comply with national legislation, a wide variety of mechanisms have been proposed for making such lighters child resistant, which is to say, substantially inoperable by children of less than five years of age. In practice the child resistance of a lighter is established by empirical testing by a group of children of less than five years of age in accordance with the relevant Rules and Regulations of the United States Consumer Product Safety Commission.

It is essential that a child resistant lighter should always return automatically to the safe condition whenever it is released by the user. Some known lighters are designed to be manipulated to a stable, enabled condition in a first, enabling step, so that a second, ignition step may then be carried out, after which the lighter resets automatically to the safe condition. Since such lighters are capable of being left inadvertently in the enabled condition for an indeterminate length of time, after which the lighter may be ignited without any further child-resisting impediment, they are no longer considered to meet this essential criterion.

Examples of such lighters include U.S. Pat. No. 6,102,689, which discloses a roll-and-press lighter with a catch which normally prevents depression of the lever; and EP0611096 A2, U.S. Pat. Nos. 5,271,731, 6,095,795, 5,324,193, and 5,704,776, which all disclose roll-and-press lighters in which either the lever or an element attached to the lever normally engages the lighter body so that it cannot be depressed. In order to release the lever and ignite the lighter, the user must first push the catch or lever or other element to a stable, intermediate position, in which it is retained by a corresponding engaging formation on the lighter body. The lighter remains in this intermediate condition until the user rotates the wheel assembly and depresses the lever in a second, conventional roll-and-press action, which ignites the lighter without any further child-resisting impediment.

In order to operate a roll-and-press lighter, it is essential that the lever is depressed to release gas to the burner as soon as the sparkwheel has been rotated and before the sparks produced by its rotation against the flint have time to decay. This is accomplished by the rapid roll-and-press operation which is familiar to users of this type of lighter. For this reason it would be difficult or impossible in practice to ignite the last described lighters by applying both inward and downward forces to the lever pad in a single operation after rotating the wheel assembly, and without first setting the locking mechanism to the stable, intermediate position. Since the stable intermediate position is therefore an essential requirement for such lighters to operate, locking mechanisms of this last mentioned class are considered unsuitable for use in a modern child resistant lighter.

In addition to the requirement for automatic reset, it is important that a child resistant lighter should be easily operable by the adult user without undue effort and inconvenience, while offering a high level of resistance to operation by children. Since disposable roll-and-press lighters are manufactured in large numbers and sold at very low cost, it is also important that the costs of materials, assembly and tooling are minimized.

U.S. Pat. No. 5,971,748 and WO01/38795 A1, both to the present applicant, disclose roll-and-press lighters having mechanisms for preventing depression of the lever, but which avoid the need for a stable, intermediate position of the mechanism by providing for the wheel assembly to engage the mechanism and move it to the enabled position as it rotates. When the user applies sufficient force to the wheel assembly, the lever is released so that it can then be immediately depressed by the user's digit.

Although these last mentioned lighters automatically return to the safe condition whenever they are released by the user, they incur the disadvantage that, since the child resistant mechanism is released only by applying force to the wheel assembly, they may not prevent a child from releasing the mechanism by rolling the knurled thumbwheels along the floor. Moreover, in use, the periphery of the wheel assembly is repeatedly rotated at high speed against the mechanism. The resulting wear tends to increase the force required to release the mechanism, making the lighter more difficult for the adult user to operate.

Many prior art lighters have incorporated safety catches which normally block operation of the lever or wheel assembly and which must be manipulated to an unblocking position prior to ignition of the lighter. Such catches are often necessarily small and fiddly to operate and make the lighter more difficult for adults to use. They can also require substantial changes to the lighter body, necessitating extensive and costly re-tooling. Moreover, in some lighters the method of operation of the safety catch may be evident to the observant child, and the lighter may then be vulnerable to operation by imitation of the actions of the adult user.

For all of these reasons it is therefore preferred not to provide the lighter with a separate safety catch which is directly operable by the user, but instead to alter the operating characteristics of the lighter so that it is inherently inoperable by a small child.

This approach is exemplified by JP 2002048341A, which provides a leaf spring beneath the depressible pad of the operating lever so as to increase the force required to depress the lever. Analogous mechanisms are also known in other types of lighter. For example, U.S. Pat. No. 5,971,751 discloses a piezoelectric lighter which has a resiliently compressible, pressure absorbing device arranged below the operating cap so as to increase the force required to depress it. U.S. Pat. No. 2,498,377 discloses a geared type lighter in which the sparkwheel is rotated by a depressible operating cap; the cap is mounted on a sprung stem which is provided with a latch device with a lip which engages the lighter body. The user must apply sufficient pressure to the operating cap to disengage the lip from the lighter body, which releases the operating cap for rapid downward motion and so ensures reliable ignition.

In each of these lighters the user is required to apply a heavy initial pressure in order to achieve ignition, and the roll-and-press lighter of JP 2002048341A requires the user to maintain this pressure in order to maintain the flow of gas and hence the flame. In practice however many users find it uncomfortable or even impossible to apply the additional pressure required to ignite such a lighter and keep it burning.

U.S. Pat. No. 5,947,715 discloses a roll-and-press lighter in which a projection extends downwardly from the underside of the depressible pad on the lever. The projection has an inclined lower surface which abuts a resiliently biased leg housed in a cavity below the lever. When an adult user applies sufficient pressure to the pad, the leg is forced aside by the inclined lower surface of the projection, allowing the lever to be depressed. Alternatively the leg may incorporate a user operable safety catch, in which case a separate spring means may be used.

This lighter enjoys the advantage that, after the user has applied an initial force sufficient to disengage the corresponding abutting surfaces, less force is then required to maintain the lever in the depressed position. However, the additional components may substantially increase production and assembly costs, especially since the additional components must be inserted into the cavity before assembly of the lever, which substantially complicates the assembly procedure. The child resistant mechanism also requires a relatively large cavity beneath the lever, which reduces the capacity of the fuel reservoir as well as requiring substantial re-tooling for production of the upper part of the lighter body as well as the lever.

U.S. Pat. No. 6,099,297 discloses a roll-and-press lighter having a comparable arrangement wherein a resilient leg extends downwardly from the underside of the depressible pad of the lever into a cavity in the lighter body. The lower end of the leg normally engages the curved upper surface of a block which is fixed to the lighter body. When the adult user applies sufficient force to the pad, the lower end of the leg is forced to one side so that it slides off the block, allowing the lever to move downwards so as to open the valve. The resilient leg is necessarily of substantial length and thickness, and like the lighter of U.S. Pat. No. 5,947,715 requires substantial re-tooling of the lighter body as well as the lever.

In both of the last mentioned lighters, the child resistance of the lighter depends critically on the ability of the resilient leg to return to the safe position after each actuation. In each case the leg must be sufficiently rigid to withstand the force which a small child may apply to the lever without buckling or collapsing. At the same time it must be sufficiently resilient to move aside so as to permit depression of the lever when the predetermined amount of force is applied by the adult user.

In practice it is difficult to balance these properties so as to achieve a consistent minimum actuation force in production. Moreover, repeated flexing of the leg during the lifetime of the lighter may result in permanent, plastic deformation which although slight is sufficient to alter the child resistance of the lighter beyond its designed parameters.

In an alternative approach, WO 99/46539 discloses a roll-and-press lighter wherein a resiliently biased ignition button is housed below the depressible pad of the lever. Rather than engaging the lever, the button protrudes through a hole in the lever so as to directly engage the user's thumb.

Since the ignition resistance button is biased by means of a coil spring, it provides a resistance to the user's thumb which can be expected to remain constant throughout the lifetime of the lighter. However, in order to maintain the flame, the adult user is disadvantageously obliged to maintain the additional coil spring in compression once the lighter has been ignited. As noted above with reference to the lighter of JP 2002048341A, this is difficult for many users.

SUMMARY OF THE INVENTION

It is the object of the present invention to provide an effective child resistant mechanism for a roll-and-press lighter which resets automatically to the safe condition whenever the lighter is released by the user, remains reliable in operation over the lifetime of the lighter, is easy for the adult user to operate, can be manufactured without substantial additional cost and does not compromise the performance of the lighter.

According to the present invention there is provided a child resistant roll-and-press lighter in accordance with the appended claims.

In each of its embodiments the present lighter is operable only by the application by the user's digit of at least a minimum predetermined force, sufficient to disengage the abutment and counterabutment surfaces, to the pad of the lever.

Thus the pad is depressed, and the valve is opened, when and only when at least the predetermined force is applied by the user to the pad of the lever. Since the present lighter does not require a safety catch which is directly operable by the user, it avoids the risk of an observant child learning to operate the lighter by imitation. Whenever the lever pad is released by the user—typically, but not necessarily, after actuation of the lighter—the biasing means re-engages the abutment and counterabutment surfaces so as to automatically return the lighter to the safe condition, in which depression of the pad by application of less than the predetermined force is prevented.

The predetermined actuation force is determined during prototyping by adjusting inter alia the biasing forces and the features of the abutment and counterabutment surfaces through a process of empirical testing as described above, so as to be greater than that which a child of under five years can apply. Although the predetermined force is greater than that required to depress the lever pad of a conventional (non-child resistant) roll-and-press lighter, it is surprisingly found that the adult user is able to operate the present lighter in each of its embodiments without difficulty or discomfort.

This is due in part to the fact that once the predetermined force has been applied to disengage the abutment and counterabutment surfaces, less force is then required to maintain the lever pad in the depressed position.

More particularly however, the present invention recognises that in roll-and-press lighters as distinct from other types of lighter, the actions of a small child in attempting to ignite the lighter may be reliably distinguished from those of an adult, not only in the amount of force which the child is able to apply to the lever pad, but also in the speed at which the child is able to rotate the wheel assembly.

The applicant has found that the adult user is typically able to rotate the wheel assembly at a significantly higher speed than can a small child playing with the lighter, and in consequence the adult's digit will be moving at a significantly higher speed when it leaves the thumbwheels and falls onto the pad of the lever. The kinetic energy of the moving digit of the typical adult user is found to be sufficient to supply the required predetermined force to disengage the abutment and counterabutment surfaces without the user being sensible of any significant additional effort. Once the lever is released for depression, the kinetic energy is no longer available but the reduced force required to maintain the lever in the depressed position is then no more than would be required by a conventional (non-child resistant) roll-and-press lighter.

In each of its embodiments the child resistant mechanism of the present lighter achieves compactness and economy of materials in comparison with the prior art lighters discussed above, and avoids the need for a deep cavity below the lever pad and hence for any reduction in the size of the fuel reservoir. It is also capable of being implemented with relatively little re-tooling. Since the novel lighter can be implemented by making relatively small changes to the components of a conventional lighter, it is also easy to assemble and can be introduced to existing automatic assembly lines without extensive and costly alterations. Moreover, the lighter benefits from enhanced reliability and effectiveness over its entire working life, as will be further explained below.

Further features and advantages will become evident from the following illustrative embodiments which are described by way of example and without limitation to the scope of the invention, and with reference to the accompanying drawings, in which:

DESCRIPTION OF THE INVENTION

Figure 1A:
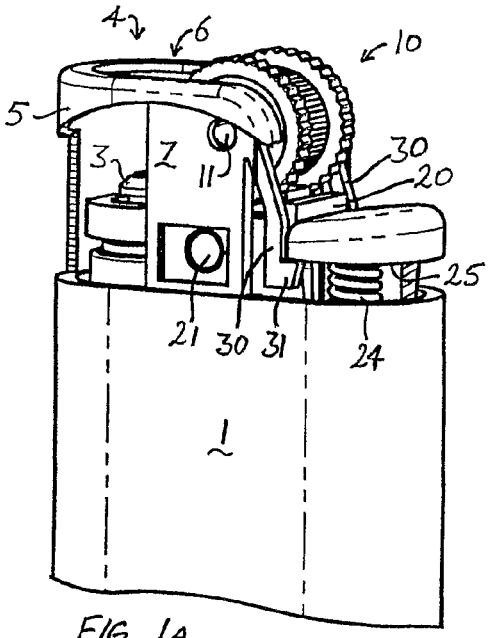
FIG. 1A shows a first child resistant roll-and-press lighter in the safe, rest position, i.e. with the abutment and counterabutment surfaces engaged to prevent depression of the lever pad by less than the predetermined force.

Various components of the lighter, including in some figures part of one of the thumbwheels, are shown partially cut away for clarity. Corresponding parts are indicated by the same reference numerals in each of the Figures.

Figure 1B:
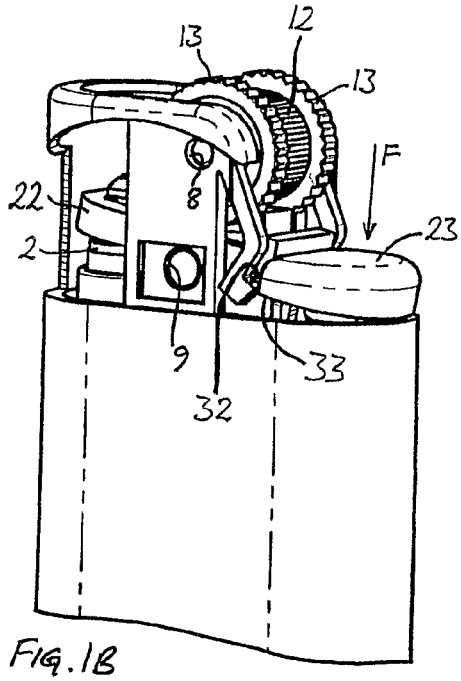
FIG. 1B shows the first lighter in the actuated position, i.e. with the lever pad depressed following disengagement of the abutment and counterabutment surfaces.

Referring to FIGS. 1A and 1B, the first lighter includes a plastics lighter body 1 which contains a reservoir of pressurised fuel. A valve assembly comprising a valve 2 and a burner nozzle 3 is mounted on the upper end 4 of the lighter body and surrounded by a pressed steel windshield 5 having an opening 6 at its upper end from which a flame is emitted when the lighter is operated. The lighter body includes two upwardly extending lateral wall elements 7, of which one can be seen in the illustration, which together support the windshield.

A rotatable wheel assembly 10 has an integral axle 11 which is mounted at each end in a bearing 8 in a fixed position in each respective wall element 7. The wheel assembly includes a sparkwheel 12 arranged between two thumbwheels 13, although alternatively for example only one of the thumbwheels might be provided. A flint 14, which cannot be seen here but is visible in some of the other figures, is slidably housed in a cavity in the lighter body and biased into engagement with the sparkwheel 12 by means of a flint spring. The wheel assembly thus engages the flint but (apart from its axle bearings) does not contact any other component of the lighter.

A plastics lever 20 is mounted on the lighter body 1 between the lateral wall elements 7 so that it pivots about its integral axle 21, which is housed at each end in a circular bearing 9 in each respective wall element 7. At one end the lever terminates in a forked arm 22, which embraces the valve assembly between the valve 2 and the burner nozzle 3. As the arm 22 is raised it bears upwardly against a flange formed around the burner nozzle, so that it lifts the valve to release gaseous fuel from the reservoir to the burner nozzle.

At its opposite end the lever 20 is provided with an integral pad 23 which is positioned to receive the user's digit after rotation of the wheel assembly 10. The lever pad 23 is biased upwardly into the rest position (FIG. 1A) by means of a coil spring 24 which is arranged between the lighter body 1 and the downwardly facing lower surface 25 of the pad.

In use, the user draws his digit, typically the thumb, rapidly across the thumbwheels 13 so that the roughened surface of the sparkwheel 12 is accelerated to a sufficiently high speed to generate a sheaf of sparks as it abrades the flint 14. In order to achieve ignition at least a minimum spark density is required, which in turn requires at least a minimum rotational speed of the wheel assembly. As the user's digit passes off the thumbwheels at the end of its stroke, it falls immediately onto the pad 23 of the lever, to which it imparts a downward force F. As explained above, the faster the user's thumb travels, the higher is the speed of rotation of the wheel assembly and the greater is the force F applied to the pad 23 by the user's digit as its kinetic energy is expended at the end of its stroke.

Two lever engaging elements 30 are moulded integrally with the wall elements 7 of the lighter body from plastics material, so as to form slender, elongate arms which extend downwards from the upper end 4 of the lighter to the lever 20. The lower end of each lever engaging element forms a hook 31 with an upwardly facing abutment surface 32. A downwardly facing counterabutment surface 33 is formed on the lower surface 25 of the lever pad 23. As soon as any force is applied to the pad 23 of the lever, the lever engaging elements act in tension to resist depression of the pad.

Although each lever engaging element 30 is of relatively small cross sectional area and hence is relatively economical of material, it is strong in tension generally in the direction of the force F which is applied to the lever pad 23 by the user's thumb. In directions transverse to the direction of the force F each lever engaging element is sidewardly deformable as shown in FIG. 1B, but resiles to its rest position once released. Whenever the user's digit is removed from the lever pad 23, the coil spring 24 urges the lever to return to the rest position as shown in FIG. 1A.

The coil spring 24 and the inherent resilience of the lever engaging elements 30 together form biasing means which urge the abutment surface 32 and the counterabutment surface 33 into engagement, as shown in FIG. 1A, as the lever 20 returns to the rest position. The configuration of the lever engaging elements and of the abutment and counterabutment surfaces (which may for example be sloped, curved, roughened or otherwise adapted) is selected so that part of the downward force F applied to the lever pad 23 is directed transversely so as to urge the lever engaging elements towards the disengaged position as shown in FIG. 1B.

The characteristics of the lever engaging elements 30 and of the abutment 32 and counterabutment 33 surfaces are selected so as to predetermine a minimum actuation force F which must be applied to the lever pad 23 in order to disengage the abutment and counterabutment surfaces and so release the lever. When a force less than the predetermined minimum force is applied to the lever pad 23, the abutment and counterabutment surfaces remain in engagement and the lever pad 23 is prevented from moving downwards so that the lever 20 cannot rotate and no fuel is released.

A child playing with the lighter is thus unable to obtain any significant movement of the lever, even by imitating the actions of the adult user, since the child will typically be unable to rotate the wheel assembly 10 at the speed necessary to impart sufficient kinetic energy to its digit so as to depress the lever pad 23. Without the assistance of the kinetic energy of a rapidly moving digit, the user is sensible of a substantially increased resistance to depression of the lever pad 23 which is too great for a child to overcome. The lighter thus provides a high level of resistance to operation by children while being readily operable by the normal actions of the adult user.

Since the lever engaging elements engage the lever in tension, relatively little material is required for their manufacture. Little or no modification of the lever is required, which minimises the costs of re-tooling, and since the lever engaging elements are moulded integrally with the walls 7 of the lighter body, no additional assembly step is required. The lighter is thus economical to prototype and manufacture.

Moreover, since the tensile, lever engaging elements are relatively slender and hence relatively flexible in the transverse direction, they are subjected to minimal stress in the actuated position. This ensures that they return reliably to their rest position throughout the lifetime of the lighter whenever the lever pad is released. The lighter thus benefits from more reliable and constant child resistancy for the duration of its working life.

In order to operate the lighter the adult user rotates the wheel assembly 10 in the normal way so that his thumb falls onto the lever pad 23 at the end of its stroke. As soon as the user's thumb engages the pad 23 the engaging elements 30 are placed in tension. As described above, the kinetic energy imparted by the rapid movement of the typical adult user's thumb is sufficient to apply at least the minimum predetermined force F to the lever pad, so that the abutment and counterabutment surfaces disengage and release the lever pad, which is immediately depressed by the user's digit as shown in FIG. 1B. This rotates the lever 20 about its axle 21 so that the forked arm 22 raises the burner nozzle 3 and so opens the valve 2 to release fuel from the reservoir.

Conveniently, each lever engaging element is supported by the lateral wall element 7 adjacent the wheel assembly axle bearing 8 as shown, but in alternative embodiments the lever engaging elements might be arranged elsewhere on the lighter body, or even on the windshield, and may extend upwardly or downwardly so as to engage respectively either the forked arm 22 or the pad 23 ends of the lever 20. One lever engaging element, or more than two lever engaging elements, could also be used. The lever engaging element may also have a different shape from that shown, and may for example incorporate one or more convolutions or cutouts which form hinge portions. The coil spring 24 is reliable and durable but alternative biasing means might be used if desired, and separate biasing means might also be employed for returning the lever engaging elements 30 to the rest position.

Desirably, the windshield 5 is arranged to enclose the lever engaging elements so that they are inaccessible by the user, preventing tampering which might reduce the child resistancy of the lighter. In the example shown, the hook 31 of each lever engaging element is arranged to move towards the burner nozzle 3 when the lighter is actuated, so that the windshield may be of standard dimensions and so enclose the engaging elements without requiring any re-tooling, but in alternative embodiments the lever engaging elements might be arranged to move in a different direction.

Figure 2A:
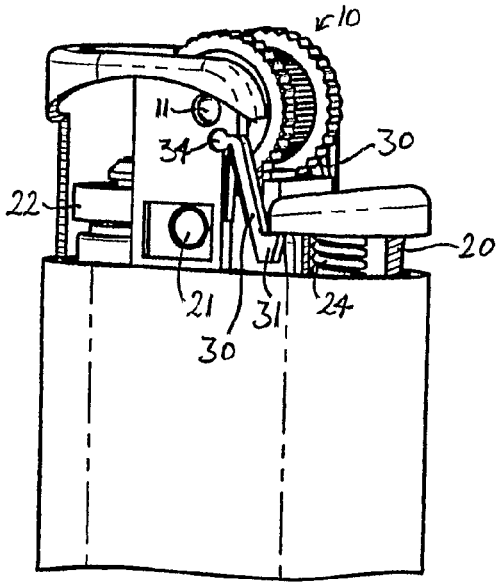
FIGS. 2A and 2B show a second lighter in respectively the rest (A) and actuated (B) positions.
Figure 2B:
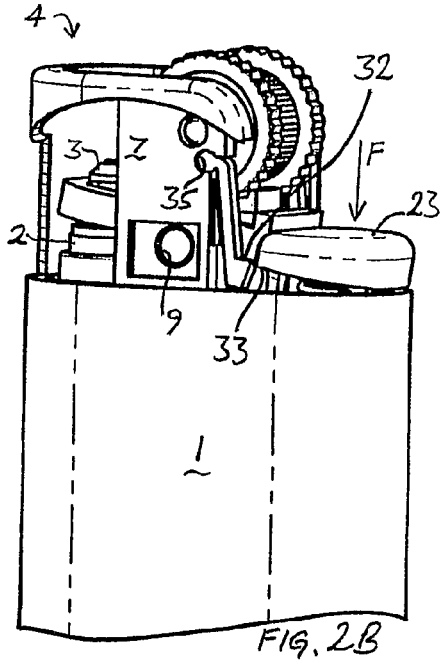

Referring to FIGS. 2A and 2B, in a second lighter, two lever engaging elements 30 are formed similarly to those of the first lighter, but as separate components rather than as integral parts of the wall elements 7. Each lever engaging element has a key portion 34 which is inserted into a corresponding socket 35 in the wall element 7. This enables the lighter body and the lever engaging elements to be molded from different plastics materials. For example, the lever engaging elements may be made from a relatively elastic plastics material, while the lighter body is made from a relatively inelastic plastics material. Alternatively, the lever engaging elements might be made from metal. In alternative embodiments the lever engaging elements may be provided with separate spring means.

The minimum actuation force may be increased by providing microscopic or macroscopic interlocking surfaces on the abutment and counterabutment surfaces which increase the lateral force required for disengagement.

Figure 3A:
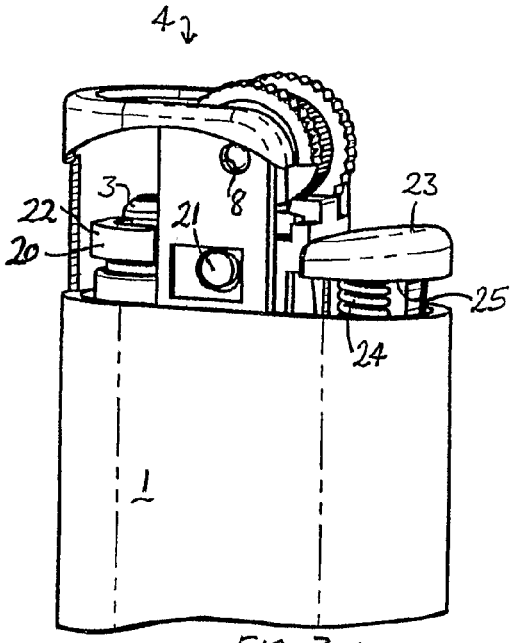
FIGS. 3, 4 and 5 show respectively third, fourth and fifth lighters in respectively the rest (A), enabled (B) and actuated (C) positions.
Figure 3B:
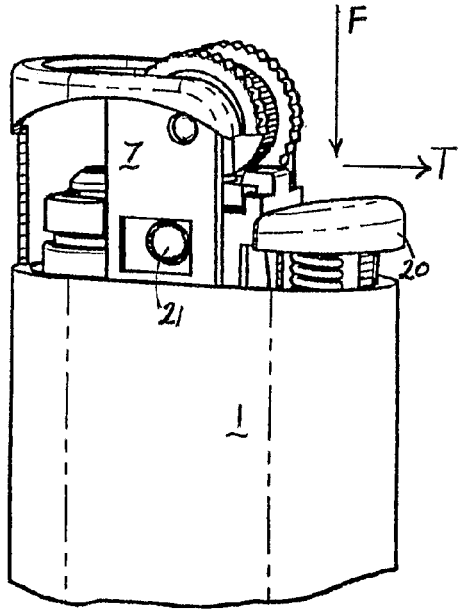
Figure 3C:
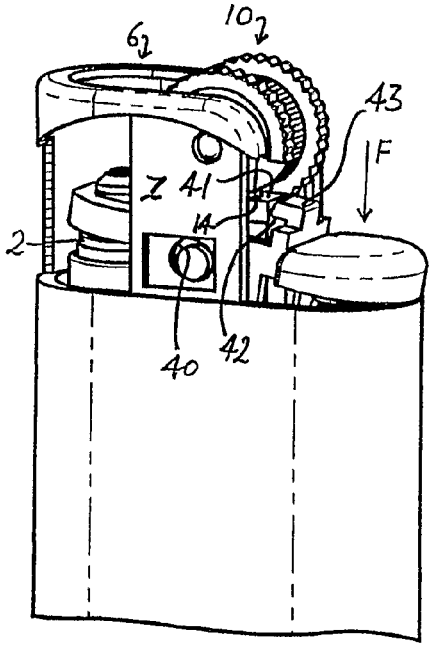

Referring to FIGS. 3A, 3B and 3C, a third lighter includes, similarly to the first and second lighters, a lighter body 1, a combined valve 2 and burner nozzle 3 assembly, a wheel assembly 10, and a plastics lever 20 rotatably mounted on an integral axle 21 and having a pad 23 which is biased to the rest position (FIG. 3A) by a helical spring 24.

Like the first and second lighters, the wheel assembly 10 is rotatably mounted in a fixed position on the lighter body so that (apart from its bearings) it is in frictional contact only with the flint. Unlike the first and second lighters however, the lever axle 21 is supported in enlarged, slotted or elongate bearing holes 40 in the wall elements 7, so that the axle 21 and hence the whole lever is free to translate in the direction T, which is transverse to the direction of the actuation force F and hence to the direction of movement of the pad 23 as it is depressed by the user.

An upwardly facing abutment surface 41 is formed on the lighter body adjacent the flint 14, and a downwardly facing counterabutment surface 42 is formed on a hook shaped engaging element 43 which is an integral part of the lever 20 and extends upwardly, i.e. towards the upper end 4 of the lighter.

In this lighter the coil spring 24 is arranged to urge the lever to move, both in translation and in rotation to the safe, rest position shown in FIG. 3A, whenever the user's digit is removed from the lever pad 23. In the rest position, the abutment and counterabutment surfaces are engaged so as to prevent depression of the lever pad 23 by less than the predetermined force F.

The abutment 41 and counterabutment 42 surfaces are formed so that a part of the actuation force F applied to the lever pad by the user is directed to translate the lever 20 in the direction T towards a second, enabled position (FIG. 3B). The corresponding surfaces are so arranged that a force F of less than a predetermined minimum magnitude will not move the lever 20 fully to the enabled position, so that the abutment and counterabutment surfaces remain in engagement, preventing depression of the pad 23 and pivotal movement of the lever about its axle 21, and the lever is returned to the safe position by the biasing means 24 as soon as the force F is removed.

When (and only when) the predetermined force F is applied to the lever pad 23 by the adult user, the lever is translated in the direction T so that it moves momentarily through the enabled position (FIG. 3B) and is then immediately rotated by the continued downward pressure of the user's digit to actuate the lighter. In the enabled position, the counterabutment surface 42 is disengaged from the abutment surface 41 and the lever is freed for rotational movement about its axle 21. The translational movement of the lever is accommodated at the burner nozzle 3 by an elongate slot in the forked arm 22. The lever pad 23 is then immediately depressed by the user's digit to the third, actuated position as shown in FIG. 3C, which raises the forked arm 22 and so opens the valve to release fuel from the reservoir.

In a development, an additional spring is used to bias the lever towards the burner nozzle, and so to increase the minimum actuation force.

Figure 4A:
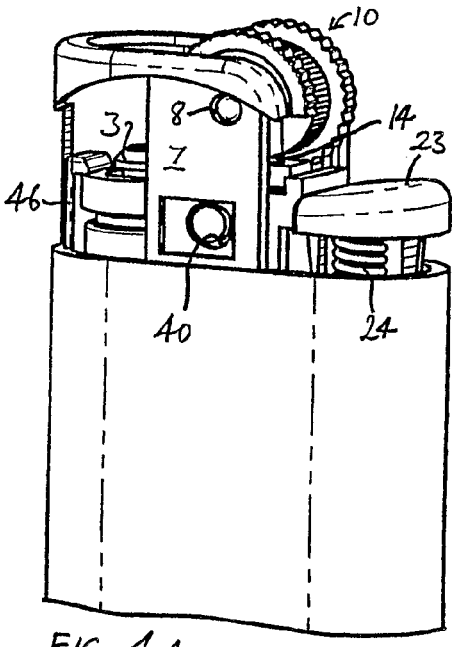
Figure 4B:
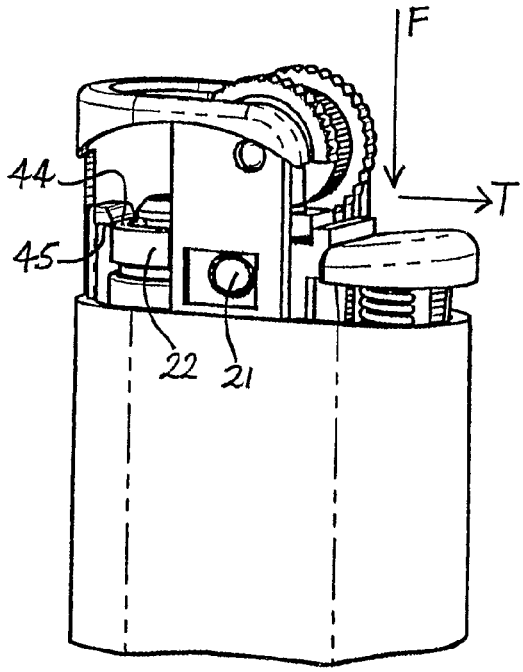
Figure 4C:
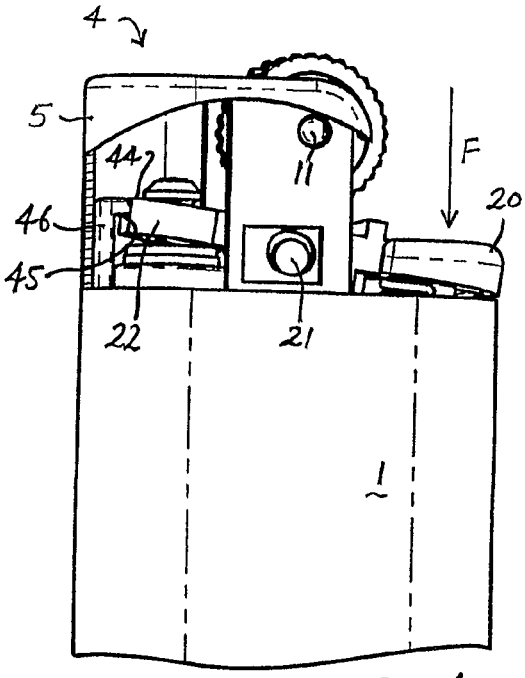

Referring to FIGS. 4A, 4B and 4C, a fourth lighter is formed generally as the third lighter except for the abutment and counterabutment surfaces. In this lighter the upwardly facing counterabutment surface 44 is formed on the forked arm 22 of the lever, and the downwardly facing abutment surface 45 is formed on an upwardly (i.e. towards the upper end 4 of the lighter) extending, hook shaped lever engaging element 46 which forms part of the lighter body adjacent the burner nozzle 3. Alternatively, the engaging element 46 may be a separate element which is mounted on the lighter body.

Similarly to the third lighter, the lever 20 is mounted in oversized or elongate bearings 40 for translational movement in the direction T and biased to the safe position (FIG. 4A) by the spring 24. When the adult user applies the minimum predetermined force F to the pad 23 of the lever, the configuration of the abutment and counterabutment surfaces urges the lever to translate in the direction T to a second, enabled position (FIG. 4B) in which the counterabutment surface 44 disengages from the abutment surface 45, freeing the lever for rotational movement about its axle 21. The lever pad can then immediately be depressed by the user's digit to the third, actuated position as shown in FIG. 4C.

As described with reference to the third lighter, the abutment and counterabutment surfaces are arranged so that a force F smaller than the minimum predetermined actuation force is inadequate to translate the lever 20 fully to the enabled position, so that the abutment and counterabutment surfaces remain in engagement to prevent depression of the pad 23.

In the third lighter the counterabutment surface 42 and, in the fourth lighter, the abutment surface 45 are formed on tensile engaging elements 43, 46 which engage respectively the corresponding abutment 41 and counterabutment 44 surfaces in tension when the pad 23 is depressed by the user. In both embodiments the tensioned engaging element is substantially rigid, so that full translation of the lever is required before the corresponding surfaces disengage.

Alternatively, the lever 20 may be mounted for translation as shown, and the abutment and counterabutment surfaces arranged to engage in compression, i.e. without the use of tensile, engaging elements. In this case the counterabutment surface is conveniently arranged under the pad of the lever, and the abutment surface in a corresponding position on the lighter body. Alternatively for example, the counterabutment surface may be arranged on the upwardly facing surface of the lever on the burner side of the lever axle 21, and the abutment surface in the corresponding position on the lighter body. As the lever translates to the enabled position the abutment and counterabutment surfaces disengage and slip past each other to free the lever for rotation as described above.

Both the third and fourth lighters benefit from an economical and very compact construction which requires minimal adaptation and re-tooling and does not require any additional steps in assembly. Moreover, since the durable coil spring 24 forms the biasing means which returns the lighter to the safe condition, and since neither of the abutment and counterabutment surfaces nor the engaging element (if any) is stressed by the force F applied to the pad 23 following actuation of the lighter, the danger of permanent plastic deformation of the safety critical components is avoided and the minimum actuation force of the lighter remains reliably constant during its lifetime.

The child resistant components are also desirably inaccessible by the user, and may be arranged variously within the windshield, adjacent the burner or flint, or under the lever pad 23, and hence are resistant to tampering which might otherwise defeat the child resistancy of the lighter.

In alternative embodiments, the tensile engaging elements may be formed as resilient elements and the lever may be mounted in conventional bearings such as bearing holes 8 as shown in FIGS. 1 and 2 so that it is free to rotate but not free to translate. The engaging elements then function similarly to those of the first and second lighters, deflecting transversely to the direction of the applied force F so as to release the lever for rotation when the minimum actuation force is applied to the pad 23.

This may be achieved for example by forming the engaging element 46 of the fourth lighter as a relatively slender, resilient element which is urged by the configuration of the abutment and counterabutment surfaces to bend away from the lever 20 when the predetermined force F is applied to the pad 23, releasing the lever for rotational movement. When the lever pad is released by the user, the forked arm 22 is returned to the rest position by the spring 24 and the engaging element 46 slides along the end surface of the forked arm 22 until it returns to its rest position as shown in FIG. 4A, so re-engaging the abutment and counterabutment surfaces.

Alternatively for example the engaging elements may form part of the wall elements 7, with the counterabutment surfaces formed on the adjacent, upwardly facing surface of the lever. For example, each engaging element may comprise a narrow, elongate section of one respective wall element 7, defined and separated at its sides from the wall element by two slits formed in the wall element parallel with the longitudinal axis of the lighter, and at its upper end by a single, transverse slit, so as to form a resilient tongue which is attached at its lower end to the wall element and extends upwardly towards the upper end 4 of the lighter. An inwardly extending ledge is formed at the upper end of each tongue, and the counterabutment surface is formed on the downwardly facing, lower surface of the ledge, so as to engage the upper surface of the forked arm 22 as the pad 23 is depressed. The slight outward movement of the upper end of the tongue as the lighter is actuated is accommodated by the clearance between the side wall of the windshield 5 and the wall element 7.

In a still further embodiment, both the abutment and counterabutment surfaces may be formed on separate engaging elements which engage one another in tension. Each engaging element may also be resiliently deformable as described above in the transverse direction, in which case the maximum lateral deflection of each engaging element may then be reduced to half of that required when a single resilient engaging element is used.

In yet further embodiments the abutment surface may be formed on another component of the lighter, such as the windshield, rather than on the lighter body.

Figure 5A:
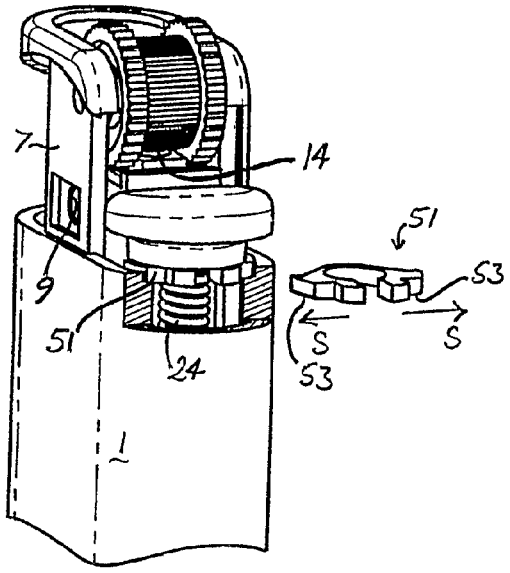
Figure 5B:
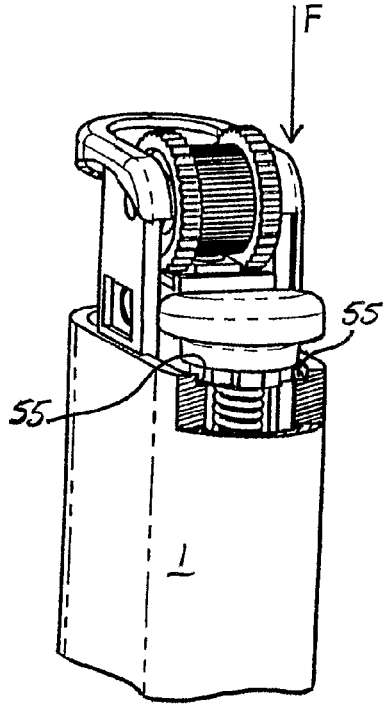
Figure 5C:
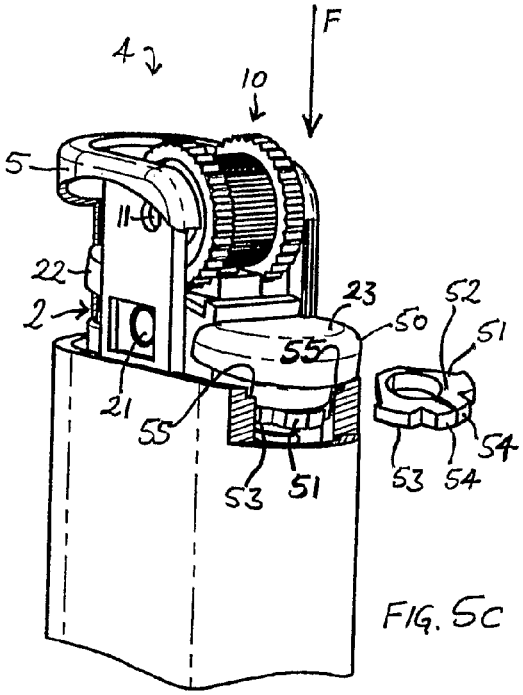

Referring to FIGS. 5A, 5B and 5C, a fifth lighter includes, similarly to the foregoing lighters, a lighter body 1 containing a reservoir of fuel, a valve 2 which forms a combined assembly with a burner nozzle, a wheel assembly 10 as described above, and a plastics lever.

The lever comprises a lever body 50 with an integral pad 23 at one end, and a resiliently biased lever catch 51 which is slidably mounted on the lever body between the downwardly (i.e. away from the upper end 4 of the lighter) facing, lower surface of the pad 23 and the fuel reservoir. In the figures the lever catch 51 is shown in position in the lighter and is also illustrated in exploded view beside the lighter in respectively its rest (FIG. 5A) and actuated (FIG. 5C) positions.

The lever body 50 is rotatably mounted on an integral axle 21 in circular bearing holes 9 in the wall elements 7 of the lighter body, and terminates at the opposite end to the pad 23 in a forked arm 22 which engages the valve assembly. A coil spring 24 is arranged below the lever pad 23 and urges the pad 23 and lever catch 51 upwardly into the rest position as shown in FIG. 5A whenever the user's digit is removed from the pad 23.

The lever catch may be retained in position beneath the pad 23 by the spring 24 which bears upwardly against the lower surface of the lever catch 51. Alternatively the spring 24 may bear directly against the lower surface of the pad 23 through the central opening in the lever catch, and the lever catch may be retained by separate guide means against the lower surface of the pad 23 so that it is easily assembled together with the lever body 50 prior to assembly of the lever body 50 and the lighter body 1.

The lever catch 51 is formed from plastics material as a generally fiat, arcuate, resilient element and has two downwardly facing counterabutment surfaces 53, and a generally flat upwardly facing upper surface 52 which slidably engages the lower, downwardly facing surface of the pad 23.

Two corresponding upwardly facing abutment surfaces 55 are formed on the lighter body 1 so that they form internal shoulders below the pad 23 as shown. As the lever catch 51 returns to the rest position (FIG. 5A) its ends 54 spring out in the direction S, which is generally transverse to the direction of the actuation force F applied to the lever pad 23 by the user. In this position the counterabutment surfaces 53 engage the abutment surfaces 55 so as to prevent depression of the pad 23, and hence pivotal movement of the lever body 50, by application of less than a predetermined force F. The spring 24 and resilient lever catch 51 thus form biasing means which act together to urge the abutment surfaces 55 and the counterabutment surfaces 53 into engagement whenever the user's digit is removed from the pad 23.

The abutment surfaces 55 and the counterabutment surfaces 53 are so configured, for example, by being suitably sloped or ramped, or alternatively for example by virtue of their size and surface finish, that part of the actuation force F applied to the lever pad 23 by the user is directed to compress the lever catch 51 in the transverse direction, opposite to the arrows S. The characteristics of the abutment and counterabutment surfaces are selected so as to predetermine a minimum actuation force F which must be applied to the pad 23 by the user in order to disengage the surfaces and release the lever pad 23 for downward movement.

The pad is thus released for depression when (and only when) at least the minimum predetermined force F is applied by the user. Thus for example if a child applies a force less than the minimum predetermined force, the lever catch 51 is not fully compressed, and the abutment and counterabutment surfaces remain in engagement and prevent depression of the pad 23. In this condition, and similarly to the first, second, third and fourth lighters already described, the child is unable to produce any downward movement of the lever.

In order to operate the lighter, the adult user operates the wheel assembly 10 in the usual way so that his thumb falls onto the lever pad 23 at the end of its stroke. Due to the much higher speed of rotation which the adult user will typically achieve, the kinetic energy of his digit is sufficient to fully compress the lever catch 51 to a second, enabled position (FIG. 5B), in which the counterabutment surfaces 53 are fully disengaged from the abutment surfaces 55 and the lever is released for rotation about its axis 21. The user's digit then continues its travel to immediately depress the lever pad 23 to the third, actuated position, as shown in FIG. 5C, so as to raise the forked arm 22 and so open the valve 2, releasing fuel from the reservoir.

Like the foregoing embodiments, the fifth lighter benefits from a compact construction which obviates the need for a deep cavity below the lever pad 23 and minimizes the requirement for re-tooling of the lighter body and the lever. Moreover, once the lighter is actuated, the lever catch 51 remains in the compressed condition below the lever pad 23 as shown in FIG. 5C until the lever pad 23 is released. Since in its compressed condition the lever catch 51 is not subjected to any further downward pressure applied to the lever pad by the user, but is merely retained by the walls of the lighter body 1, it is not strained by repeated actuation and hence its resilience and the child resistancy of the lighter remain reliably constant over the working life of the lighter.

In alternative embodiments the lever catch may be shaped differently to that shown, and may be provided with separate biasing means for biasing it in the rest position into engagement with the abutment surface formed on the lighter body.

For example, the lever catch may comprise a flat, rigid plate which is slidingly housed beneath the pad 23 in guides formed on the lever body 50. Alternatively for example it may comprise a spring biased rod which is housed in a transverse bore in the pad 23. The lever catch may move generally along the axis of the lever body 50 rather than transversely to the axis of the lever body as shown, and may for example be formed from metal rather than from plastics material.

In summary, a child resistant roll-and-press lighter includes at least one abutment surface which engages a corresponding counterabutment surface on the lever. The surfaces disengage to release the lever for pivotal movement, when and only when at least a predetermined minimum force is applied to the lever pad by the user. The abutment or counterabutment surface may be arranged on a transversely deformable, resilient engaging element which engages the corresponding surface in tension. Alternatively the lever may be mounted in elongate slots so as to translate and so disengage the cooperating surfaces when the minimum force is applied by the user. Alternatively the counterabutment surface may be arranged on a sliding catch housed beneath the lever pad. The minimum force is easily applied by the adult user by rotating the wheel assembly at normal speed.

The invention is not limited by the embodiments described, and many further adaptations may be made within the scope of the appended claims.

I claim:

1. A child resistant roll-and-press lighter comprising:

a lighter body containing a reservoir of fuel;

a burner nozzle;

a valve for releasing fuel from said reservoir to said burner nozzle;

at least one abutment surface;

a lever operable to open said valve and having at least one counterabutment surface and a pad for receiving a user's digit;

a rotatable wheel assembly including a sparkwheel and at least one thumbwheel, said sparkwheel cooperating with a flint for igniting released fuel;

biasing means which urges said at least one abutment surface and said at least one counterabutment surface into engagement whenever the user's digit being removed from said pad; and, at least one engaging element having one of said at least one abutment surfaces and said at least one counterabutment surfaces formed thereon;

wherein said at least one engaging element acts in tension when the user's digit engages said pad so as to prevent depression of said pad and thereby to prevent release of said fuel from said reservoir when said at least one abutment surface and said at least one counterabutment surface are engaged with each other; and, wherein said at least one abutment surface and said at least one counterabutment surface being normally engaged with each other so as to prevent depression of said pad by application thereto of less than a predetermined force, and said at least one abutment surface and said at least one counterabutment surface being arranged so as to disengage from each other and so permit depression of said pad only when at least said predetermined force is applied to said pad by the user.

2. The child resistant lighter as defined in claim 1, wherein said at least one counterabutment surface is formed on said at least one engaging element, and said at least one engaging element forms part of said lever.

3. The child resistant lighter as defined in claim 1, wherein said at least one abutment surface is formed on said at least one engaging element, and said at least one engaging element is supported by said lighter body.

4. The child resistant lighter as defined in claim 3, wherein said lighter body includes two lateral wall elements which support said wheel assembly, and said at least one engaging element is supported by at least one of said lateral wall elements.

5. A child resistant roll-and-press lighter comprising:

a lighter body containing a reservoir of fuel;

a burner nozzle;

a valve for releasing fuel from said reservoir to said burner nozzle;

at least one abutment surface;

a lever operable to open said valve and having at least one counterabutment surface and a pad for receiving a user's digit, said lever being mounted for pivotal movement by depression of said pad in a first direction;

a rotatable wheel assembly including a sparkwheel and at least one thumbwheel, said sparkwheel cooperating with a flint for igniting the released fuel; and, biasing means which urges said at least one abutment surface and said at least one counterabutment surface into engagement whenever the user's digit is removed from said pad;

wherein said at least one abutment surface and said at least one counterabutment surface being normally engaged with each other so as to prevent depression of said pad by application thereto of less than a predetermined force;

wherein said at least one abutment surface and said at least one counterabutment surface being arranged so as to disengage from each other and so permit depression of said pad only when at least said predetermined force is applied to said pad by the uses; and, wherein said lever is mounted for translational movement in its entirety in a second direction between a rest position and an enabled position, and wherein in said rest position said at least one abutment surface is engaged with said at least one counterabutment surface so as to permit translation of said lever in said second direction but prevent depression of said pad in said first direction and to prevent pivotal movement of said lever when said predetermined force is applied to said pad by the user, and wherein in said enabled position said at least one abutment surface is disengaged from said at least one counterabutment surface so as to permit depression of said pad and pivotal movement of said lever.

6. The child resistant lighter as defined in claim 5, wherein said lever includes an engaging element, said at least one counterabutment surface being formed on said engaging element, and wherein said engaging element acts in tension when the user's digit engages said pad so as to prevent depression of said pad and to prevent said release of fuel from said reservoir when said at least one abutment surface and said at least one counterabutment surface are engaged with each other.

7. The child resistant lighter as defined in claim 5, wherein said at least one abutment surface is formed on an engaging element which extends from said lighter body, and wherein said engaging element acts in tension when the user's digit engages said pad so as to prevent depression of said pad and to prevent said release of fuel from said reservoir when said at least one abutment surface and said at least one counterabutment surface are engaged with each other.

8. A child resistant roll-and-press lighter comprising:

a lighter body containing a reservoir of fuel;

a burner nozzle;

a valve for releasing fuel from said reservoir to said burner nozzle;

at least one abutment surface;

a lever operable to open said valve and having at least one counterabutment surface and a pad for receiving a user's digit, said lever comprising a lever body and a resiliently biased lever catch, said lever body pivotably mounted on said lighter body, said resiliently biased lever catch slidably mounted on said lever body for sliding movement relative to said lever body between a rest position and an enabled position, said at least one counterabutment surface being formed on said lever catch;

a rotatable wheel assembly including a sparkwheel and at least one thumbwheel, said sparkwheel cooperating with a flint for igniting said released fuel; and, biasing means which urges said at least one abutment surface and said at least one counterabutment surface into engagement whenever the user's digit is removed from said pad;

wherein said at least one abutment surface and said at least one counterabutment surface being normally engaged with each other so as to prevent depression of said pad by application thereto of less than a predetermined force, said at least one abutment surface and said at least one counterabutment surface being arranged so as to disengage from each other and thereby permit depression of said pad only when at least said predetermined force is applied to said pad by the user;

wherein in said rest position said at least one abutment surface being engaged with said at least one counterabutment surface so as to prevent depression of said pad and pivotal movement of said lever; and, wherein in said enabled position said at least one abutment surface being disengaged from said at least one counterabutment surface so as to permit depression of said pad and pivotal movement of said lever.

9. The child resistant lighter as defined in claim 8, wherein said at least one abutment surface is formed on said lighter body, and said lever catch comprises a generally arcuate, resilient element which is arranged between said pad of said lever and said fuel reservoir.

10. A child resistant roll-and-press lighter comprising:

a lighter body containing a reservoir of fuel;

a burner nozzle;

a valve for releasing fuel from said reservoir to said burner nozzle;

an abutment surface;

a lever operable to open said valve, said lever including a pad, said pad designed for receiving a use's digit, said lever moveable between a first and second position, said first position causing said valve to be in a closed position, said second position causing said valve to be in an open position to allow for said releasing of said fuel from said reservoir to said burner nozzle;

a counterabutment surface;

an engaging surface positioned on said abutment surface, said counterabutment surface, or both said abutment and counterabutment surface; when said engaging surface is positioned on said abutment surface, said engaging surface designed to engage said counterabutment surface; when said engaging surface is positioned on said counterabutment surface, said engaging surface designed to engage said abutment surface;

a rotatable wheel assembly including a sparkwheel and a thumbwheel, said sparkwheel cooperating with a flint for igniting fuel release from said valve; and, a biasing mechanism that creates a biasing force on said lever that urges said lever into said first position whenever the user's digit is removed from said pad;

wherein said engaging element designed to cause tension between said counterabutment surface and said abutment surface whenever the user's digit initially engages said pad, said lever positioned in said first position whenever the user's digit initially engages said pad, said tension between said counterabutment surface and said abutment surface designed to prevent depression of said pad and movement of said lever from said first position to said second position when the user applies a force on said pad that is less than a predetermined force necessary to overcome said biasing force and said tension between said counterabutment surface and said abutment surface when said counterabutment surface and said abutment surface are engaged together; and, wherein said engaging element designed to enable said abutment surface and said counterabutment surface to disengage from each other and to permit movement of said lever from said first position to said second position only when the user applies a force on said pad that is at least said predetermined force.

11. The child resistant lighter as defined in claim 10, including a flexible hook that includes said abutment surface, said abutment surface including said engaging surface, said engaging surface designed to engage said counterabutment surface located on said lever, said flexible hook not connected to said lever, said flexible hook designed to deform when at least said predetermined force is applied to said pad to thereby cause said engaging surface to retract from and disengage from said counterabutment surface located on said lever.

12. The child resistant lighter as defined in claim 10, including a hook connected to said lever, said hook positioned forwardly of said pad, said hook includes said counterabutment surface, said counterabutment surface including said engaging surface, said counterabutment surface designed to overlie said abutment surface when said lever is in said first position and to retract from said abutment surface when said lever is said second position at least said predetermined force is applied to said pad.

13. The child resistant lighter as defined in claim 10, including a hook connected to said body of said lighter and spaced from and not connected to said lever, said hook positioned forwardly of said pad and adjacent to said burner nozzle, said hook includes said abutment surface, said abutment surface including said engaging surface, said abutment surface designed to overlie said counterabutment surface when said lever is in said first position and to retract from said counterabutment surface when said lever is said second position at least said predetermined force is applied to said pad, said counterabutment surface designed to lift above said engaging surface when said lever moves to said second position.

* * * * *